United States Patent [19]

Aileo

[11] 4,290,149

[45] Sep. 22, 1981

[54] METHOD OF MAKING AN INDIVIDUALLY FITTED HELMET

[75] Inventor: Jackson A. Aileo, Carbondale, Pa.

[73] Assignee: Gentex Corporation, Carbondale, Pa.

[21] Appl. No.: 120,476

[22] Filed: Feb. 11, 1980

Related U.S. Application Data

[63] Continuation of Ser. No. 905,154, May 12, 1978, abandoned.

[51] Int. Cl.[3] ..... A42B 3/02

[52] U.S. Cl. ..... 2/414; 2/417

[58] Field of Search ..... 2/413, 417, 420, 414, 2/410, 4–8, 411, 412, 423, 425, 192, 418, 419; 128/2.1 B

[56] References Cited

U.S. PATENT DOCUMENTS

| | | | |
|---|---|---|---|
| 631,880 | 8/1899 | Ross | 2/418 |
| 3,274,612 | 9/1966 | Merrian | 2/425 |
| 3,289,212 | 12/1966 | Morgan | 2/420 |
| 3,495,272 | 2/1970 | Tempelhof | 2/420 |
| 3,623,477 | 11/1971 | Trent | 128/2.1 B |
| 3,668,704 | 6/1972 | Conroy et al. | 2/413 |
| 3,882,546 | 5/1975 | Morton | 2/413 |
| 3,972,075 | 8/1976 | Alevras | 2/410 |
| 3,994,028 | 11/1976 | Aileo et al. | 2/419 |
| 4,032,127 | 6/1977 | Lipfert | 2/420 |

*Primary Examiner*—Louis Rimrodt

*Attorney, Agent, or Firm*—Shenier & O'Connor

[57] ABSTRACT

An individualized helmet assembly and method of and apparatus for making the same in which a helmet liner having a plurality of apertures is removably secured inside a fixture in the form of a rigid template simulating a helmet shell and having apertures registering with the apertures in the liner. Resilient, snugly fitting spacer plugs are inserted in the apertures from the inner side of the liner, and the entire assembly is placed over the wearer's head. Selected plugs are pushed inwardly against the head of the wearer properly to position and stabilize the helmet-simulating fixture and liner on the wearer's head. The remaining spacers are then pushed inwardly until they abut the wearer's head. Finally, with the assembly removed from the wearer's head, the portions of the spacers protruding outwardly from the template are cut off, and the liner is separated from the template and assembled with an outer helmet shell to complete the construction.

9 Claims, 5 Drawing Figures

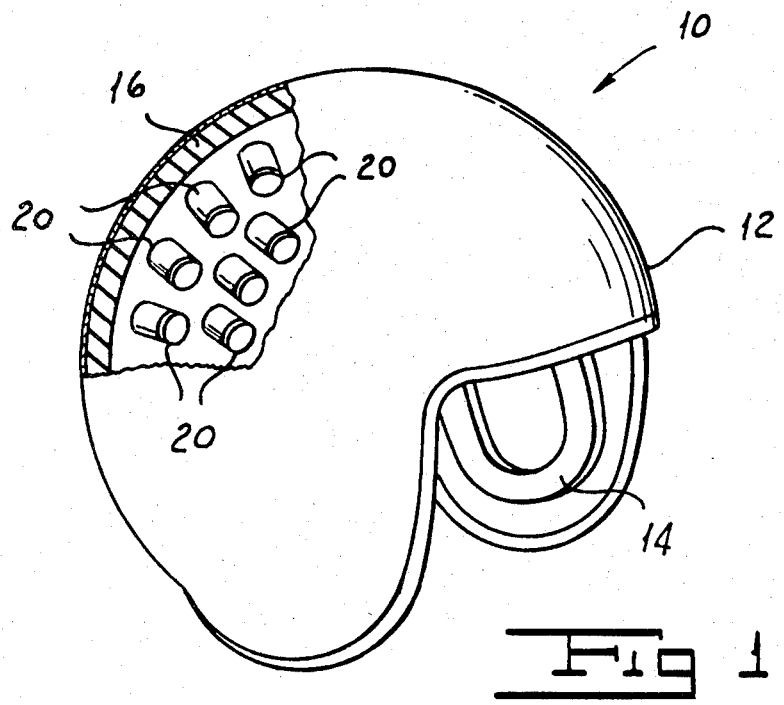
Fig 1
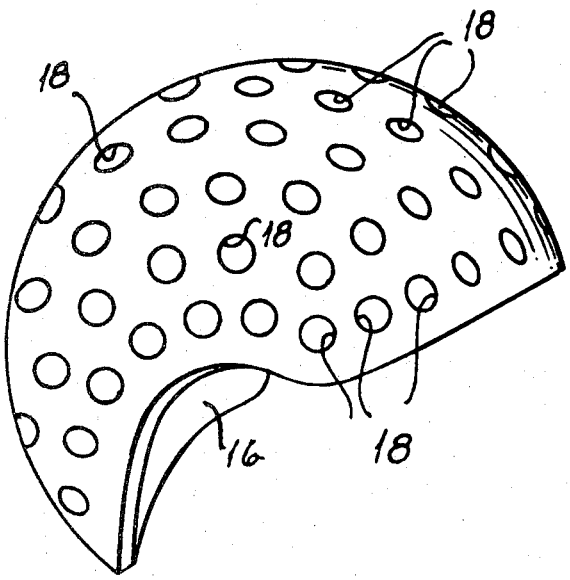
Fig 2
Fig 3
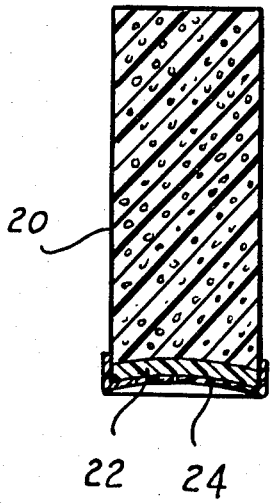

METHOD OF MAKING AN INDIVIDUALLY FITTED HELMET

This is a continuation of application Ser. No. 905,154, filed May 12, 1978 now abandoned.

BACKGROUND OF THE INVENTION

Protective helmets having hard outer shells for use in various military, industrial or other applications are well known in the art. In such helmets, it is generally desirable to provide a resilient liner assembly between the outer shell and the wearer's head to help absorb shock. While straps or similar elements have customarily been used in the past for this purpose, they must be adjustable to accommodate various head sizes, resulting in some wobbling from front to back or from side to side.

Various proposals for individually fitted, or formfitting, liner assemblies have been suggested in an attempt to overcome this defect. Such proposals involve, for example, making an individual mold of the wearer's head or, as disclosed in U.S. Pat. No. 3,882,546, forming the liner in place by injecting foam between the outer shell and a thin cap stretched over the wearer's head. While these and other proposals have met with some degree of success, they are expensive and timeconsuming and are not readily adaptable for use with various helmet shell designs. More importantly, methods of the prior art for custom fitting helmets are not practicable for use in the field. Further, the broad area of contact of the completed helmet assembly with the wearer's head can result in some discomfort, particularly in closed areas, by preventing free circulation of air.

SUMMARY OF THE INVENTION

One of the objects of my invention is to provide a helmet assembly which is individually fitted to the head of a wearer.

Another object of my invention is to provide a helmet assembly which resists wobbling of the helmet shell relative to the head of the wearer.

Still another object of my invention is to provide a helmet assembly which is comfortable to wear.

A further object of my invention is to provide a method of making an individually fitted helmet assembly which is simple and inexpensive.

Yet another object of my invention is to provide a method of and apparatus for making a custom-fitted helmet which are adapted for use in the field.

Still another object of my invention is to provide a method of making an individually fitted helmet assembly which is readily adaptable to use with a variety of helmet shells.

Other and further objects of my invention will be apparent from the following disclosure.

In general, my invention contemplates a method of making an individualized helmet assembly in which a helmet liner having a plurality of apertures is removably secured inside a fixture in the form of a rigid template simulating a helmet shell and having apertures registering with the apertures in the liner. Resilient, snugly fitting spacer plugs are inserted in the apertures from the inner side of the liner, and the entire assembly is placed over the wearer's head. Selected spacers are pushed inwardly against the wearer's head properly to position and stabilize the assembly of the fixture and the liner on the wearer's head. The remaining spacers are then pushed inwardly until they abut the wearer's head. Finally, with the assembly removed from the wearer's head, the portions of the spacers protruding outwardly from the template are cut off, and the liner is separated from the template and assembled with an outer helmet shell to complete the construction of the assembly.

In making my assembly, the liner and template are only on the wearer's head for a time sufficient to push the spacers inwardly to their proper positions; the liner is bonded to the helmet shell with the members off the wearer's head, resulting in a procedure which is substantially less tedious for the intended wearer. Customizing can readily be achieved in field locations where plastic foaming facilities are not available. Further, the use of discrete spacers rather than an integral layer of foam or the like permits the free circulation of air around the wearer's head, improving comfort. Finally, since a suitable template can easily be fabricated for a particular shell type, my method is especially versatile and adaptable for use with a wide variety of helmet shells.

BRIEF DESCRIPTION OF THE DRAWINGS

In the accompanying drawings to which reference is made in the instant specification and in which like reference characters are used to indicate like parts in the various views:

FIG. 1 is a perspective view of a helmet assembly constructed according to my method, with parts broken away and with other parts shown in section.

FIG. 2 is a perspective view of the liner of the helmet assembly shown in FIG. 1.

FIG. 3 is an enlarged sectional view of one of the spacer plugs used in the assembly shown in FIG. 1 before it has been cut down to size.

DETAILED DESCRIPTION OF THE PREFERRED EMBODIMENT

Figure 4:
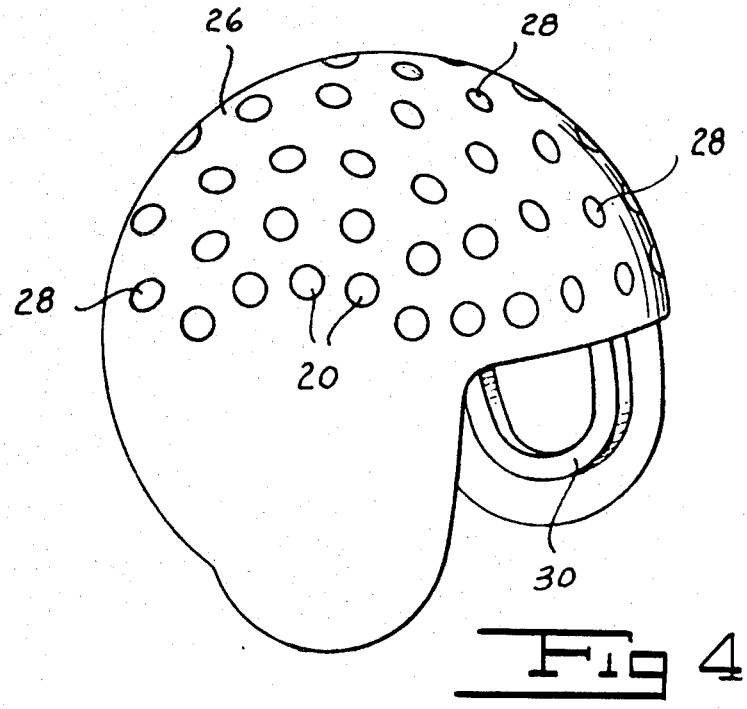
FIG. 4 is a perspective view of the fixture used to form the assembly shown in FIG. 1.

Referring now to FIGS. 1 to 3, a helmet assembly constructed according to my method, indicated generally by the reference numeral 10, includes a rigid outer shell 12 formed of any suitable material and fitted with an earcup assembly 14 on each inner side thereof. A liner 16 assembled inside the outer shell 12 and formed of any suitable material such as polystyrene foam is formed with a plurality of apertures 18, each of which snugly receives a generally cylindrical plug or insert 20 the body of which may be polystyrene foam. Preferably, I provide the liner with about 45 openings 18. Any suitable material such as an epoxy resin or the like may be used to bond the liner 16 to the shell 12. Preferably, the density of the polystyrene foam used is between 2 and 5 pounds per cubic foot, with a density of 5 pounds per cubic foot being the most preferred.

Both the plugs 20, which preferably are about 1 inch in diameter, and the liner 16 are formed of shock absorbing material. To assist the shock-absorbing function of the plugs 20, they preferably include cushions 22 at their inner end which are about $\frac{1}{8}$ inch thick and comprise a suitable resilient material. Such materials include the blend of nitrile rubber and polyvinyl chloride plastic sold by Uniroyal Inc. under the trademark Ensolite, as well as urethane. Plugs 20 also preferably have concave surfaces at their inner ends as shown in FIG. 3 and are capped by moisture-impervious pads 24 of leather or the like.

Figure 5:
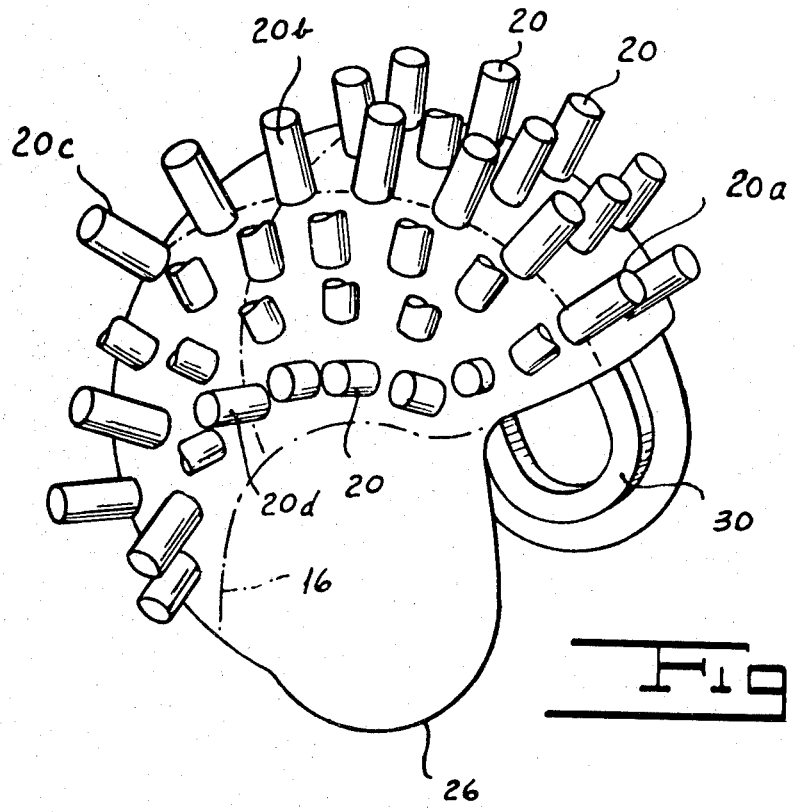
FIG. 5 is a perspective view of the apparatus illustrating an intermediate step in my method of forming the assembly of FIG. 1.

Referring now to FIGS. 4 and 5, in practicing my method of making the custom fitted helmet 10, I use a fixture of template 26 similar or identical in shape to the outer shell 12. Template 26, which is suitably formed from fiberglass with epoxy resin, has an inner surface that matches the contour of the outer surface of the liner 16 and has apertures 28 formed therethrough in registry with the apertures 18 formed through the liner 16. Template 26 also includes structures 30 simulating the earcup assembly 26 of the shell 12 to assist in proper positioning of liner 16. I removably secure liner 16 inside the template 26 in contacting relation therewith and with the apertures 18 and 28 in registry. I then insert uncut plugs 20, about 2½ inches long, through the apertures 18 and 28 from the inside of the assembly of the fixture 26 and liner 16 to provide an intermediate assembly shown in FIG. 5.

Next, with the liner 16 arranged in a suitable position over the wearer's head as determined by the template 26, selected plugs 20 are pushed inwardly until they contact the wearer's head properly to position and stabilize the assembly of the fixture 26 and liner 16 on the wearer's head. I do this by pushing in plugs 20*a*, 20*b* and 20*c* disposed along the front-to-back median line of the template 26 and then plugs 20*d* disposed on opposite sides of plug 20*b* adjacent to the ends of the transverse median line of the liner about three-fourths of their total uncut length inwardly. It will readily be appreciated that the overall shape of the fixture in simulating an actual outer shell as well as the presence of the earcup assemblies makes possible the accurate positioning of the assembly on the wearer's head. When the positioning and stabilizing step just described has been completed, the remaining spacers 20 are pushed into contact with the wearer's head.

The assembly is then removed as a unit from the wearer's head and the portions of the plugs 20 protruding outwardly from the fixture 26 cut off to facilitate separation of the fixture from the liner 16. Finally, after the liner 16 is separated and any remaining outwardly protruding plug portions levels down, the liner is assembled with the outer shell 12 to complete the construction. I may bond the liner 16 to the outer shell by the use of any suitable bonding agent such as an epoxy cement. Alternatively, I may releasably secure the liner 16 within the shell by means of spaced complementary pairs of areas of readily releasable fastener material of the hook and loop type made by the American Velcro Company and sold under the trademark "Velcro". It will be apparent that material of one type will be on the outer surface of liner 16 and of the other type on the inner surface of shell 12. This has the advantage of permitting one custommade liner to be used with a variety of outer shells.

It is to be emphasized that my method of making a custom-fitted protective helmet can be carried out in the field since it does not require any sophisticated equipment such as plastic foam generating equipment and the like. All that is required is a fixture 26, respective supplies of shells 12, liners 16 and spacers 20, as well as a supply of a binding agent. My method may be practiced by relatively unskilled persons.

It will be seen that I have accomplished the objects of my invention. My helmet assembly is formfitting and resists wobbling of the helmet shell relative to the head of the wearer. My helmet assembly is comfortable, while at the same time being simple and inexpensive to make. Finally, my helmet assembly is made using a method which is readily adaptable to use with a variety of helmet shells.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. A method of making a custom-fitted helmet including the steps of assembling a perforated liner within a perforated fixture having the general configuration of a helmet outer shell with the liner perforations registering with the fixture perforations, assembling a plurality of elongated spacer plugs in said registering perforations with the major portions of the lengths of said spacer plugs outside said fixture, placing the assembly of said liner and said fixture and said plugs over the head of the intended wearer, pushing plugs located adjacent to the ends of the fore-and-aft median line and adjacent to the ends of the lateral median line and adjacent to the intersection of said median lines into engagement with the wearer's head properly to position said liner with reference to and to stabilize said assembly on the wearer's head, pushing the remaining spacer plugs into engagement with the wearer's head, removing said assembly from the wearer's head, removing the portions of said spacer plugs extending out from said fixture, removing said liner from the fixture, and securing said liner to a helmet shell.

2. A method of making a customfitted helmet including the steps of assembling a perforated liner within a perforated fixture having the general configuration of a helmet outer shell with the liner perforations registering with the fixture perforations, assembling a plurality of elongated spacer plugs in said registering perforations with the major portions of the lengths of said spacer plugs outside said fixture, placing the assembly of said liner and said fixture and said plugs over the head of the intended wearer, first pushing selected spaced plugs into engagement with the wearer's head properly to position said liner with reference to and to stabilize said assembly on the wearer's head, pushing the remaining spacer plugs into engagement with the wearer's head, removing said assembly from the wearer's head, removing the portions of said spacer plugs extending out from said fixture, removing said liner from said fixture, and securing said liner to a helmet shell.

3. A method of making a customfitted helmet including the steps of assembling a perforated liner within a perforated fixture having the general configuration of a helmet outer shell with the liner perforations registering with the fixture perforations, assembling a plurality of elongated spacer plugs in said registering perforations with the major portions of the lengths of said spacer plugs outside said fixture, placing the assembly of said liner and said fixture and said plugs over the head of the intended wearer, pushing said spacer plugs into engagement with the wearer's head properly to position said liner on the wearer's head, removing said assembly from the wearer's head, removing the portions of said plugs extending outwardly of said fixture, removing said liner from said fixture, and securing said liner in a helmet shell.

4. A method of making a custom-fitted helmet including the steps of assembling a perforated liner within a perforated fixture having the general configuration of a helmet outer shell with the liner perforations registering with the fixture perforations, assembling a plurality of spacer plugs in said registering perforations for sliding movement relative to the assembly of said fixture and said liner, sliding said spacer plugs relative to said assembly and into engagement with the wearer's head properly to position said liner with reference to the wearer's head, removing the portions of said plugs extending out from said fixture, removing said liner from said fixture, and securing said liner to an outer shell.

5. In a method of making a helmet individually fitted to the head of the wearer, the steps of placing a liner having a plurality of apertures formed therethrough and having a plurality of resilient inserts slidably received by said apertures over the head of the wearer, sliding said inserts relative to said liner and into engagement with the wearer's head, and bonding the outer surface of said liner to a helmet shell.

6. In a method of making a custom-fitted helmet liner assembly from a unitary liner which is generally coextensive with the upper portion of the wearer's head and which is provided with a plurality of spacer-receiving openings extending therethrough and a plurality of elongated spacers having a cross-sectional shape corresponding to that of said openings, the steps of placing said liner over the head of the intended wearer with said spacers inserted through said openings and sliding said spacers in the direction of the lengths thereof toward the wearer's head to bring the ends thereof into engagement with the wearer's head.

7. In a method of making a custom-fitted helmet liner assembly from a unitary liner which is generally coextensive with the upper portion of the wearer's head and which is provided with a plurality of spacer-receiving openings extending therethrough and a plurality of elongated spacers having a cross-sectional shape corresponding to that of said openings, the steps of placing said liner over the head of the intended wearer with said spacers inserted through said openings, sliding said spacers in the direction of the lengths thereof toward the wearer's head to bring the ends thereof into engagement with the wearer's head, and removing the portions of said spacers extending out from said liner.

8. In a method of making a custom-fitted helmet liner assembly from a unitary liner which is generally coextensive with the upper portion of the wearer's head and which is provided with a plurality of spacer-receiving perforations extending therethrough and a plurality of elongated spacers having a cross-sectional shape corresponding to that of said perforations, the steps of assembling said liner within a perforated fixture having the general configuration of a helmet outer shell with the perforations registering with the perforations in the said liner, placing said assembly over the head of the intended wearer with said spacers inserted through said registering perforations, sliding said spacers in the direction of the lengths thereof toward the wearer's head to bring the ends thereof into engagement with the wearer's head, and removing said liner from said fixture.

9. In a method of making a custom-fitted helmet liner assembly from a unitary liner which is generally coextensive with the upper portion of the wearer's head and which is provided with a plurality of spacer-receiving perforations extending therethrough and a plurality of elongated spacers having a cross-sectional shape corresponding to that of said perforations, the steps of assembling said liner within a perforated fixture having the general configuration of a helmet outer shell with the fixture perforations registering with the perforations in said liner, placing said assembly over the head of the intended wearer with said spacers inserted through said registering perforations, sliding said spacers in the direction of the lengths thereof toward the wearer's head to bring the ends thereof into engagement with the wearer's head, removing the portions of said spacers extending out from said fixture, and removing said liner from said fixture.

* * * * *